US005186664A

United States Patent [19]

Abe

[11] Patent Number: 5,186,664

[45] Date of Patent: Feb. 16, 1993

[54] FEMALE TERMINAL

[75] Inventor: Kimihiro Abe, Shizuoka, Japan

[73] Assignee: Yazaki Corporation, Tokyo, Japan

[21] Appl. No.: 896,591

[22] Filed: Jun. 10, 1992

[30] Foreign Application Priority Data

Jun. 17, 1991 [JP] Japan ..... 3-144671

[51] Int. Cl.[5] ..... H01R 13/87

[52] U.S. Cl. ..... 439/845; 439/843

[58] Field of Search ..... 439/842–856, 439/861, 862, 246, 249, 251, 252, 380, 381

[56] References Cited

U.S. PATENT DOCUMENTS

| | | | |
|---|---|---|---|
| 2,814,025 | 11/1957 | Wade et al. | 439/845 |
| 3,120,989 | 2/1964 | Solorow | 439/843 |
| 4,342,498 | 8/1982 | Patton | 439/843 |

FOREIGN PATENT DOCUMENTS

| | | |
|---|---|---|
| 63-184472 | 12/1988 | Japan . |
| 64-12383 | 1/1989 | Japan . |

*Primary Examiner*—David L. Pirlot
*Attorney, Agent, or Firm*—Sughrue, Mion, Zinn, Macpeak & Seas

[57] ABSTRACT

A female terminal into which a male tab terminal is inserted to make electrical connection therebetween. The female terminal includes a leaf spring having a convexly curved spring portion and forwardly and rearwardly extending flat portions. A pair of engagement pieces extend from the forwardly extending flat portion in the transverse direction through support holes on the opposite side walls of the female terminal. To prevent a load from rapidly increasing in the course of an inserting operation, each of the support holes for the engagement pieces has a forwardly enlarging triangular configuration corresponding to a locus of the engagement pieces resulting from the arcuate movement of the engagement pieces due to the pivoting of the forward flat portion after the male tab terminal is inserted into the female terminal. Alternatively, each of the support holes has a forwardly enlarging sector-like configuration.

4 Claims, 3 Drawing Sheets

FEMALE TERMINAL

BACKGROUND OF THE INVENTION

The present invention relates generally to a female terminal which includes a contact leaf spring independently of a main body of the terminal. More particularly, the present invention relates to a female terminal which is constructed in such a manner as to prevent a rapid increase in the insert force required to insert a male tab into the female terminal due to deformation of the leaf spring caused when a male tab is inserted into the female terminal.

To facilitate an understanding of the present invention, a conventional female terminal will briefly be described below with reference to FIGS. 5 and 6.

FIG. 5 is a perspective view of a conventional female terminal as disclosed in a Japanese Unexamined Utility Model Publication No. 64-12383.

A female terminal 22 includes a cable connecting portion 23 on the right-hand side and an electrical contact portion 25, for receiving a male tab terminal 24, on the left-hand side as seen in the drawing. The electrical contact portion 25 is constructed such that a separate leaf spring 28 is secured to a parallelepiped-shaped terminal insert portion 27 of a main body 26 of the female terminal 22.

The leaf spring 28 includes horizontally extending flat portions 30 and 31 on opposite sides of a convexly curved spring portion 29. In addition, the leaf spring 28 includes a pair of engagement pieces 33 on the opposite sides of the flat portion 30 in the vicinity of a male tab terminal insert opening 32.

A pair of rectangular support through holes 35 are formed in the opposite side walls 34 of the terminal insert portion 27 at the lower part thereof in the vicinity of the terminal insert opening 32. The leaf spring 28 is fitted into the terminal insert portion 27 by inserting the engagement pieces 33 of the leaf spring 28 into the support holes 35 while the flat portions 30 and 31 contact a bottom wall 36 of the terminal insert portion 27.

With such a construction, as the male terminal 24 is inserted into the female terminal 23, the convexly curved spring portion 29 of the leaf spring 28 is deflected in the downward direction by depression of the forward part of the male tab terminal 24 to assume an increasingly flattened state, as shown in FIG. 6. Subsequently, each of the flat portions 30 is bent upwardly as designated by arrow A so as to pivot about a base portion 30*a* so as to maintain an initial bent angle $\theta$ which is predetermined prior to insertion of the male terminal 24. As a result, an upper corner 33*a* of each engagement piece 33 integrated with the flat portion 30 abuts against an upper end portion 35*a* of the support hole 35, causing the engagement piece 33 to experience a reaction force F. For this reason, the spring constant of the spring portion 29 is increased with the result that an insert load to be borne by the male tab terminal 24 increases rapidly in the course of inserting the male tab terminal 24, as shown in FIG. 7. Consequently, there arises a drawback in that it is difficult to insert the male tab terminal.

SUMMARY OF THE INVENTION

The present invention has been made in consideration of the aforementioned drawback.

An object of the present invention is to provide a female terminal which assures that terminal connection can be smoothly accomplished without any rapid increase in the force required to insert a male tab terminal into the female terminal.

Another object of the present invention is to provide a female terminal which assures that terminal connection can be reliably accomplished without undesirable dislocation of a leaf spring relative to a male tab terminal inserted into the male terminal.

According to the present invention, there is provided a female terminal into which a male terminal is inserted to make electrical connection therebetween, the female terminal having a leaf spring received therein to elastically contact the male tab terminal. The leaf spring comprises a convexly curved spring portion and flat portions on the opposite ends of the curved spring portion as seen in the longitudinal direction of the female terminal. Further, a pair of engagement pieces project from the forward flat portion in the transverse direction through support holes provided in the opposite side walls of the female terminal so as to engage the support holes. Each of the support holes has a forwardly enlarging triangular configuration corresponding to a locus of the engagement pieces resulting from the arcuate movement of the engagement pieces due to pivotal motion of the forward flat portion during the insertion of the male tab terminal into the female terminal.

Each of the support holes is configured such that a bottom side portion is flush with the bottom wall surface of a male tab terminal insert portion, a rear side portion, having a height slightly larger than a thickness of each engagement piece, is formed at the rear end of a base side portion, a forward side portion having a height larger than that of the rear side portion is formed at the forward end of the base side portion, and a forward sloped side portion extends between the rear side portion and the forward side portion.

In practice, the base portion of the forward flat portion of the leaf spring is positionally coincident with the bent portion of the leaf spring extending along the boundary between the curved spring portion and the forward flat portion.

To prevent undesirable dislocation of the leaf spring during each inserting operation, each of the support holes may be configured to have a forwardly enlarging sector-shaped configuration corresponding to a locus of the engagement pieces resulting from arcuate movement of the engagement pieces as they pivot about the base portion of the forward flat portion of the leaf spring when the male tab terminal is inserted into the female terminal.

Other objects, features and advantages of the present invention will become apparent from reading of the following description which has been made in conjunction with the accompanying drawings.

BRIEF DESCRIPTION OF THE DRAWINGS

The present invention is illustrated in the following drawings in which.

DESCRIPTION OF THE PREFERRED EMBODIMENTS

The present invention will be described hereinafter with reference to the accompanying drawings which illustrate preferred embodiments of the present invention.

Figure 1:
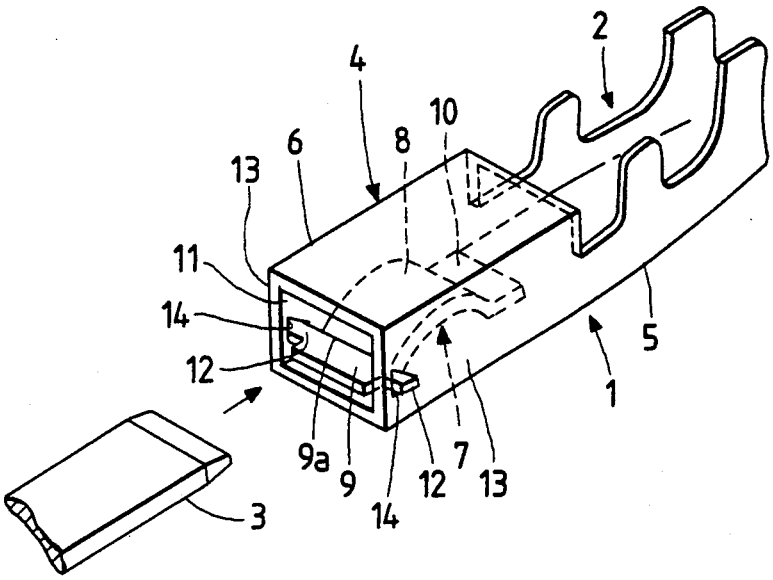
FIG. 1 is a perspective view of a female terminal in accordance with an embodiment of the present invention.
Figure 5:
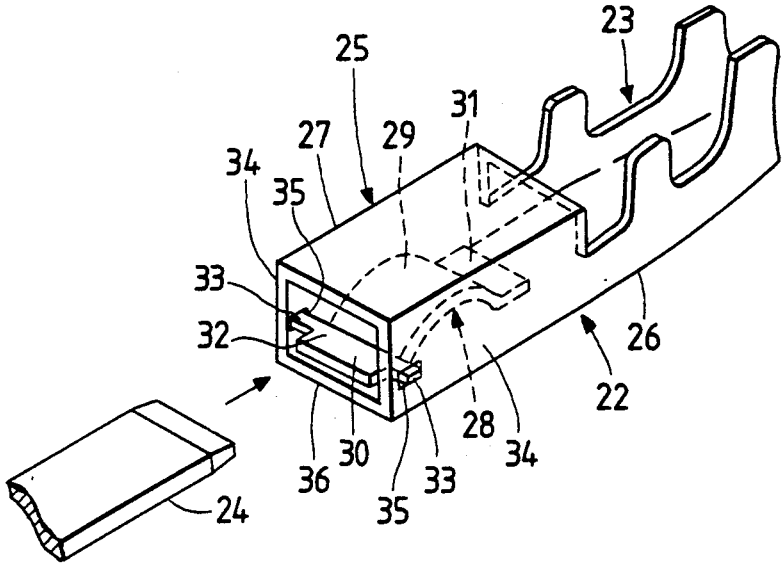
FIG. 5 PRIOR ART
FIG. 5 is a perspective view of a conventional female terminal.
Figure 6:
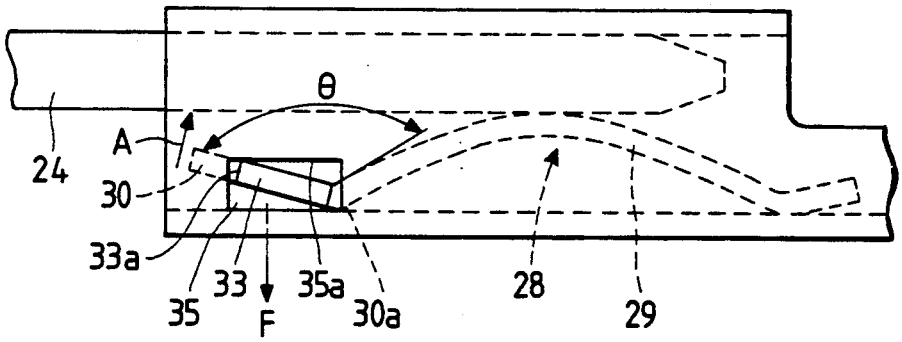
FIG. 6 PRIOR ART
FIG. 6 is a fragmentary side view of the female terminal shown in FIG. 5, particularly illustrating a male tab terminal inserted into the female terminal.

Similar to the conventional female terminal described above with reference to FIG. 5 to FIG. 7, a female terminal 1 includes a cable connecting portion on the right-hand side and an electrical contact portion 4 on the left-hand side as seen in FIG. 1. When a male tab terminal 3 is to be electrically connected to the female terminal 1, it is first inserted into the electrical contact portion 4. The electrical contact portion 4 is constructed such that a separate leaf spring 7 is secured to a parallelepiped-shaped tubular insert portion 6.

Similar to the conventional female terminal, the leaf spring 7 includes horizontally extending flat portions 9 and 10 on opposite sides of a convexly curved spring portion 8. In addition, the leaf spring 7 includes a pair of engagement pieces 12 on the opposite sides of the forward flat portion 9 in the vicinity of a terminal insert opening 11.

A pair of support through holes 14 are formed in the opposite side walls 13 of the terminal insert portion 6 in the vicinity of the terminal insert opening 11. An important feature of the present invention is that each support hole 14 has a forward enlarging triangular configuration. In particular, the configuration corresponds to a locus of the engagement pieces 12 resulting from the pivotal movement of the engagement pieces about a base portion **9*a* of the flat portion 9 of the leaf spring 7 (i.e., the bent portion of the leaf spring 7 extending along the boundary between the spring portion 8 and the flat portion 9) when the male tab terminal 3 is inserted into the female terminal 1**.

Figure 2:
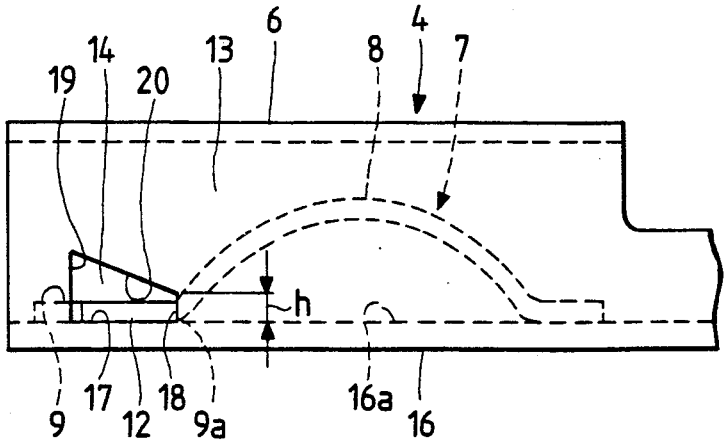
FIG. 2 is a fragmentary side view of the female terminal shown in FIG. 1, particularly illustrating essential components for the female terminal.

Specifically, as shown in FIG. 2, each support hole 14 is configured such that a bottom side portion 17 is flush with an inner surface **16*a* of a bottom wall 16 of the terminal insert portion 6, a rear side portion 18, having a height h appreciably larger than a thickness of each engagement piece 12, is formed at the rear end of the base side portion 17 (i.e., in the vicinity of the base portion 9*a* of the flat portion 9), a forward side portion 19 having a height larger than that of the rear side portion 18 is formed at the forward end of the base side portion 17, and a forwardly rising inclined side portion 20 is formed to extend from the rear side portion 18 to the forward side portion 19. The height h of the rear side portion 12** is the same as each engagement hole in the conventional female terminal, discussed above.

After each support hole 14 is formed in the side wall 13 of the male tab terminal insert portion 6 in the above-described manner, the leaf spring 7 is fitted into the male tab terminal insert portion 6 with the engagement pieces 12 engaged with the support holes 14.

Figure 3:
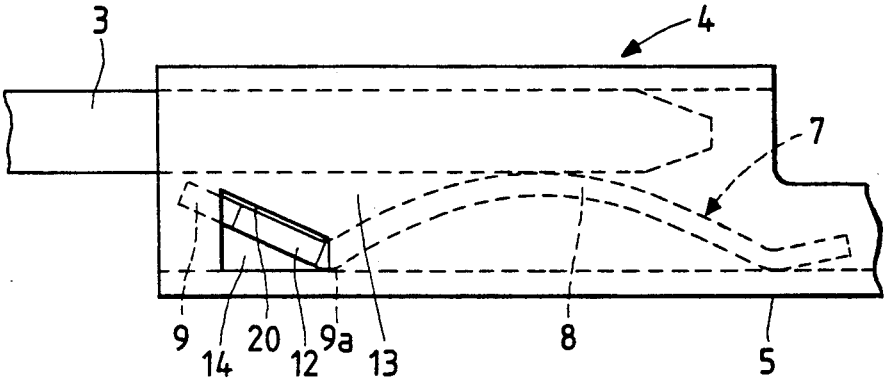
FIG. 3 is a fragmentary side view of the female terminal, particularly illustrating a male tab terminal inserted into the female terminal.

As is best seen in FIG. 3, the inclination of each of the inclined side portion 20 is designed to correspond to the angular orientation of each of the engagement pieces 12 of the leaf spring 7 after the insertion of the male tab terminal. As a result, the engagement pieces comes in substantially close contact with the inclined side portions 20 when the male tab terminal 3 is fully inserted into the female terminal 1, allowing the engagement pieces 12 to pivot about the base portion **9*a* of the forward flat portion 9. Thus, as the male tab terminal 3 is inserted into the female terminal 1, the leaf spring 7 is deformed in the downward direction by depression of the male tab terminal 3 without any undesirable interference of the engagement pieces 12 with the support holes 14 as in the conventional female terminal. Therefore, in contrast with the conventional female terminal, the spring force of the spring portion 8** does not increase rapidly during insertion of the male tab terminal into the female terminal.

Figure 7:
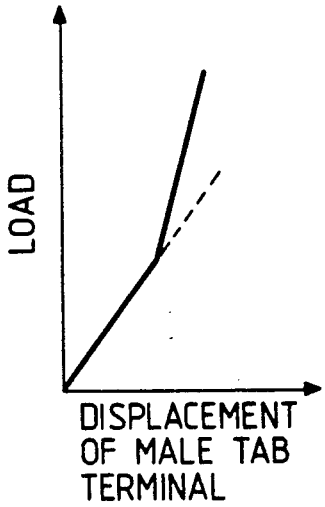
FIG. 7 is a characteristic diagram which illustrates a relationship between a load and displacement of the male tab terminal when the male tab terminal is inserted into the female terminal wherein a solid line represents a characteristic curve of the conventional female terminal and a dotted line represents a characteristic curve of the female terminal of the present invention.

It should be noted that a characteristic diagram for the female terminal of the present invention representing a relationship between a load experienced by the male tab terminal and the displacement thereof is shown by a dotted line in FIG. 7. As is apparent from the above description, according to the present invention, the male tab terminal 3 can be smoothly inserted into the female terminal 1.

Figure 4:
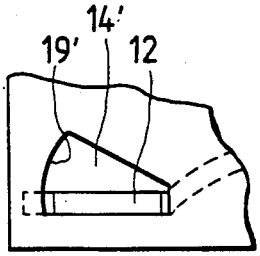
FIG. 4 is a fragmentary side view of the female terminal particularly illustrating a support hole formed through a side wall of the female terminal in the sector-shaped configuration in accordance with another embodiment of the present invention.

An alternate embodiment is illustrated in FIG. 4. In this embodiment, an arcuate portion 19, is substituted for the forward side portion 19 of the support hole 14 such that each of the support holes has a sector-like shape. As a result, the engagement pieces 12 are prevented from being undesirably dislocated in the forward/rearward direction. Consequently, the male tab terminal 3 can be inserted into the female terminal 1 while maintaining a reliable positional relationship therebetween.

While the present invention has been described above with respect to two preferred embodiments thereof, it should of course be understood that the present invention should not be limited only to these embodiments but various changes or modifications may be made without departure from the scope of the present invention as defined by the appended claims.

What is claimed is:

1. A female terminal for receiving a male terminal, comprising:

a main body portion extending in a longitudinal direction and having a cable connecting portion at one end and an electric contact portion at an opposite end thereof, said electric contact portion having an opening at a forward end thereof for receiving a male tab terminal to make electrical connection therebetween;

a leaf spring provided in said electric contact portion for urging against said male tab terminal, said leaf spring including a convexly curved spring portion extending in said longitudinal direction and a flat portion disposed at an end of said curved spring portion, said flat portion extending toward said forward end and having a pair of engagement pieces projecting in a transverse direction with respect to said longitudinal direction and being engaged in support holes provided in opposite side walls of the female terminal, wherein each of said support holes has a forward enlarging configuration corresponding to a locus of said engagement pieces resulting from arcuate movement of said engagement pieces due to pivotal motion of said flat portion upon insertion of said male terminal into the female terminal.

2. The female terminal according to claim 1, wherein aid forward enlonging configuration is shaped as a triangular-like configuration.

3. The female terminal according to claim 1, wherein said electric contact portion has a substantially rectangular cross-section having a bottom surface upon which said leaf spring is supported.

4. The female terminal according to claim 3 wherein each of said support holes are defined by a bottom portion which is flush with said bottom surface of said electric contact portion, a rear side portion having a height slightly larger than a thickness of each engagement piece, a forward side portion having a height larger than the height of said rear side portion, and an inclined side portion extending from upper ends of said rear side portion and said forward side portion.

* * * * *